United States Patent [19]

Seeley

[11] 4,289,955

[45] Sep. 15, 1981

[54] ELECTRIC HEATING ASSEMBLIES WITH A MOUNTED THERMOSTATIC SWITCH

[75] Inventor: Wayne R. Seeley, Pulaski, Va.

[73] Assignee: Emerson Electric Co., St. Louis, Mo.

[21] Appl. No.: 91,389

[22] Filed: Nov. 5, 1979

[51] Int. Cl.[3] ..... H05B 3/06

[52] U.S. Cl. ..... 219/532; 219/364; 219/536; 219/541; 337/354

[58] Field of Search ..... 219/363, 364, 366, 368, 219/532, 536, 537, 541; 337/348, 354, 363, 364, 370, 374; 174/138 J; 338/318

[56] References Cited

U.S. PATENT DOCUMENTS

| | | | |
|---|---|---|---|
| 1,460,943 | 3/1923 | Carmean et al. | 219/363 |
| 2,514,528 | 7/1950 | Wahl | 219/368 |
| 3,111,571 | 11/1963 | DeCamp | 219/364 X |
| 3,291,966 | 12/1966 | Bunting | 219/371 |
| 3,562,692 | 2/1971 | Bletz et al. | 337/354 |
| 3,631,525 | 12/1971 | Brasch | 219/366 |
| 3,641,312 | 2/1972 | Ammerman | 219/532 |
| 3,770,939 | 11/1973 | Kokjohn | 219/532 |
| 3,943,333 | 3/1976 | Kokjohn et al. | 219/532 |
| 4,131,737 | 12/1978 | Tyler | 219/532 |

*Primary Examiner*—Volodymyr Y. Mayewsky
*Attorney, Agent, or Firm*—Michael Williams

[57] ABSTRACT

The invention relates to electric heating elements, particularly of the open coil type, for installation in apparatus, such as room air conditioners or the like, wherein a thermostat is required and is positioned with its heat sensor in close proximity to an active heating portion of the heating element so as to be extremely sensitive to variations in heat. The invention insures that the thermostat is always properly installed, especially after service work has been performed on the air conditioner, and/or the heating element. Briefly, a tab extends from a terminal of the thermostat and is adapted to fit in only one relation within an opening in an insulator bushing. The bushing has an extending lug to fit in predetermined manner with a portion of a cross strip of a supporting frame to hold the bushing from substantial rotation.

7 Claims, 5 Drawing Figures

ELECTRIC HEATING ASSEMBLIES WITH A MOUNTED THERMOSTATIC SWITCH

BACKGROUND AND SUMMARY

The present invention is an improvement over the construction disclosed in U.S. Pat. No. 3,770,939, issued Nov. 6, 1973, to Leonard Dennis Kokjohn for Electric Heating Assemblies, and assigned to the assignee of the present application.

In the Kokjohn patent, a thermostat is mounted between two spaced strips which extend crosswise of a pair of frame side arms. The thermostat has a heat sensor directed toward and positioned in close proximity to an active heating portion of the resistance coil so as to be extremely sensitive to any abnormally high temperature and quickly interrupt electrical current to the heater.

Heating assemblies corresponding to the Kokjohn disclosure are still being used and perform satisfactorily. However, they have one inherent fault in that the thermostat might be improperly installed, especially after service work, so that its heat sensor is directed away from the active heating portion of the coil, instead of directed toward such portion, and this materially affects the sensitivity of the thermostat.

My invention insures that the thermostat will at all times be installed in proper manner so that its heat sensor is in predetermined relation with an active heating portion of the resistor coil. Specifically, this is accomplished by fitting a tab extending from a thermostat terminal into an opening in an insulator bushing, the tab fitting in the opening in only one way, and the bushing being held against substantial rotation.

DESCRIPTION OF THE DRAWING

In the drawing accompanying this specification and forming a part of this application, there is shown, for purpose of illustration, an embodiment which my invention may assume, and in this drawing.

DESCRIPTION OF THE PREFERRED EMBODIMENT

Figure 1:
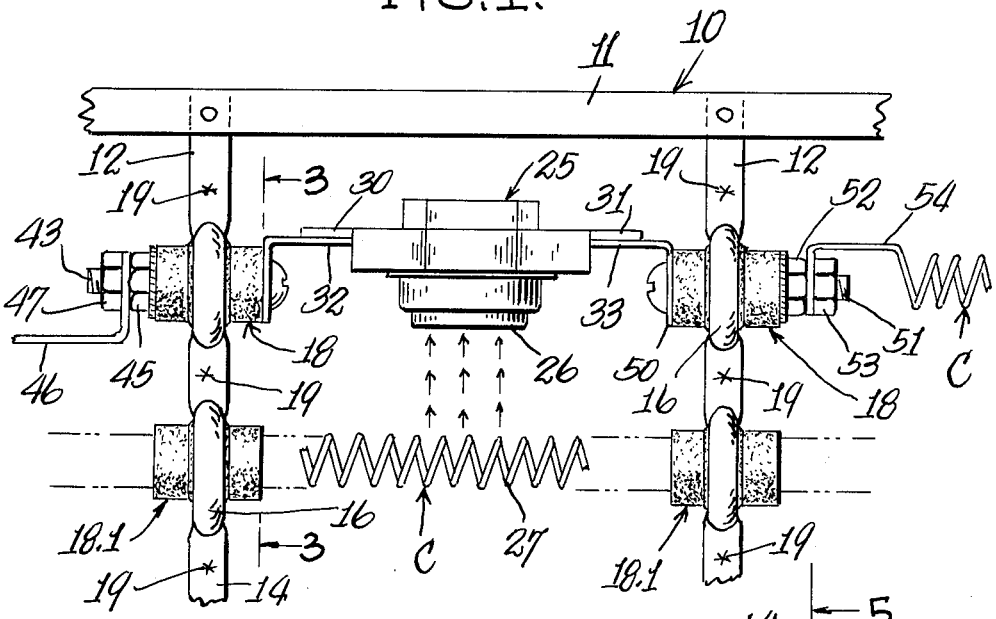
FIG. 1 is a fragmentary view showing that portion of FIG. 1 of the said Kokjohn patent which is pertinent to this disclosure.

As in the said Kokjohn patent, a support frame 10 includes a pair of parallel, spaced side arms 11 (only one shown in the drawing of this application) and a plurality of cross arms 12 (only two shown in the drawing). The cross arms 12 in the present case are each formed by a pair of matching sheet-metal strips 14, 15 each having spaced semicircular wells 16 which are arranged in complementary fashion to substantially encircle a central annular rib 17 on a ceramic insulator 18.

The strips are spot welded or riveted together at spaced points designated by the reference numeral 19 so that the matching wells 16 are securely held in closely-encircling relation with the rib 17 of each of the insulators 18. One of the insulators (the upper left-hand one in FIG. 1) is formed with a protrusion 20 which is adapted to fit within the crotch 21 formed by adjoining curved parts of the strips 14,15 to hold the insulator against substantial rotation within the matching wells. The insulator is assembled with care at the factory so that the protrusion 20 always extends in a predetermined manner (upwardly with respect to the disposition of parts in FIGS. 1 and 3), and therefore it remains in proper position even during service work since the strips 14 and 15 are rigidly joined.

Figure 2:
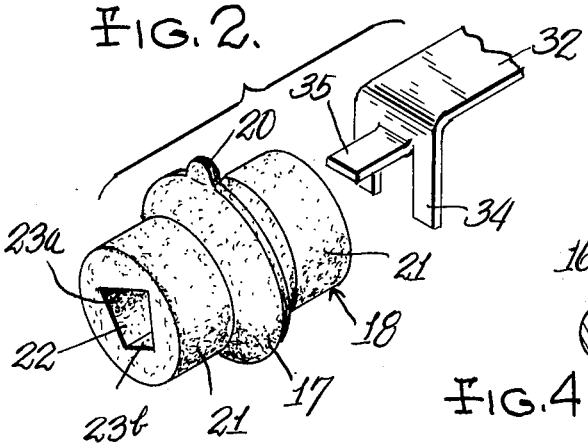
FIG. 2 is an enlarged, separated perspective view of two parts of my invention.
Figure 3:
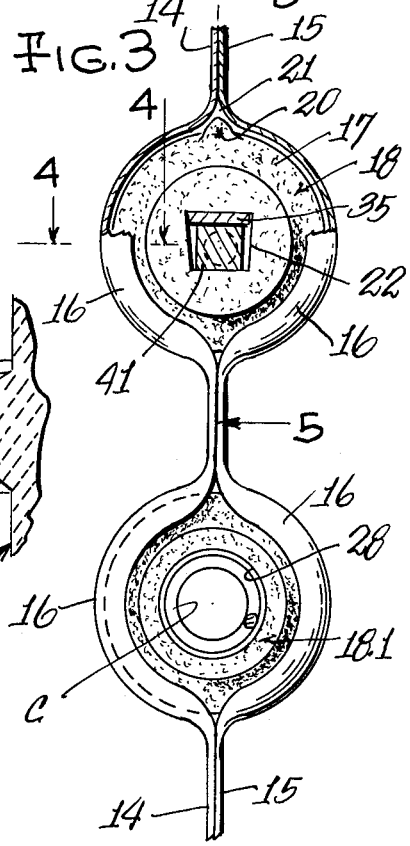
FIG. 3 is an enlarged, fragmentary sectional view corresponding to the line 3—3 of FIG. 1.
Figure 4:
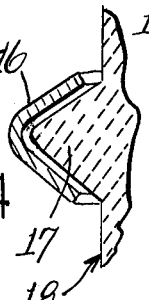
FIG. 4 is an enlarged fragmentary sectional view corresponding to the line 4—4 of FIG. 3.
Figure 5:
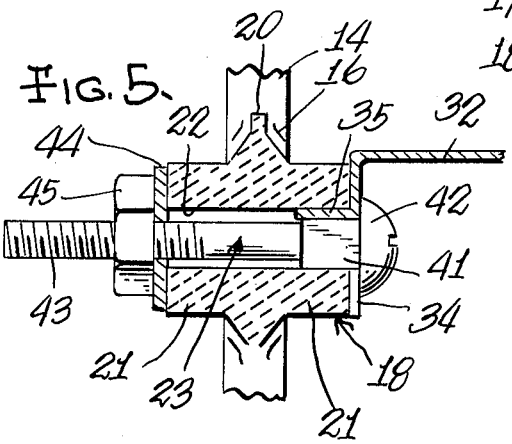
FIG. 5 is a fragmentary sectional view corresponding to the line 5—5 of FIG. 3.

Each insulator 18 has circular opposite end portions 21,21, and an axial opening 22 extends completely through the insulator for the passage of a securing bolt 23. The opening 22 in the upper right-hand insulator 18 may be round, but the opening 22 in the left-hand insulator 18 is of four-sided shape, as best seen in FIGS. 2 and 3, with the top margin **23*a* longer than the bottom margin 23*b***.

A thermostatic switch 25 is supported between adjoining cross arms 12 and this switch may be of any commercially available type, such as that manufactured by the Therm-O Disc Division of Emerson Electric Co. This switch is more specifically described in said Kokjohn patent and for this disclosure it is only necessary to specify that the switch has a heat sensor portion 26 which is directed toward, and is in close proximity to, a portion 27 of the resistor coil C, the latter being sinuous in formation as shown in said Kokjohn patent. The insulators 18.1 which support the coil C may be like the insulators 18, except that each has a large circular opening 28 to pass the coil.

The thermostatic switch 25 has oppositely-extending terminals 30,31, with metal conductor strips 32,33 respectively, welded thereto. The strip 32 has a bifurcated angled extremity 34 (see FIG. 2), the metal between the furcations being bent outwardly at right angles to form a tab 35 which is of a width to closely fit within the insulator opening 22 at its widest portion **23*a*, but is too wide to fit in the insulator opening at its narrower portion 23*b*. The insulator opening portion 23*a* and the insulator protrusion 20 are so arranged, as seen in FIG. 3, that the tab 35 will permit the thermostatic switch 25 to be installed only in the correct position with its heat sensor directed toward the coil portion 27. Since the heating element, and the apparatus with which it is assembled, is subject to service operations, this is an important aspect of my invention because heretofore it has been found that some service man have reinstalled the thermostatic switch with its heat sensor pointing away from the coil portion 27**.

The opening 22 in the ceramic bushing 18, even with the tab 35 projected therein, is large enough to pass the mounting bolt 23, the latter having a square shank portion 41 to hold it against rotation. The head 42 of the bolt clamps the bifurcated extremity 34 against the adjoining end of the ceramic insulator and the threaded shank 43 extends through and outwardly of the insulator opening. A lock washer 44 and nut 45 complete the assembly of the bolt with the ceramic bushing. A wire lead 46 (see FIG. 1) may be clamped to the bolt by a nut 47 and, as in the said Kokjohn patent, the lead 46 may be connected to a terminal which is adapted to be connected to a source of electrical energy.

The terminal strip 33 may also have a bifurcated angled extremity 50 but this extremity need not have the tab 35. The hole in the right-hand insulator bushing 18 may have a square portion to fit a like part of the bolt 51. A nut 52 on the bolt maintains the insulator assembly, and a further nut 53 may clamp an end 54 of the resistor coil C to the bolt 51. As seen in the said Kokjohn patent, the coil may have a plurality of reaches, and the opposite end (not shown) of the coil C may be connected to a second terminal.

I claim:

1. An electric heating assembly, comprising a supporting frame including a pair of arms held in spaced-apart relation, a heating coil having a reach extending crosswise of said arms, a thermostatic switch mounted between said arms and having a heat sensor portion directed toward said coil reach so as to be affected by heat issuing therefrom and adapted to interrupt electrical current to said heating coil when a predetermined high temperature has been reached, the improvement comprising:

means preventing improper installation or replacement of said thermostatic switch and insuring that said heat sensor portion is always directed toward said coil reach, said means comprising, an insulating bushing carried by one of said arms, said bushing and said arm having interfitting parts to hold said bushing against substantial rotation about its axis and in a preselected relation with respect to said one arm, means between said thermostatic switch and said bushing, interfitting in predetermined manner to hold said thermostatic switch in position with its heat sensor portion directed toward said coil reach, and a second insulating bushing carried by the other arm, said thermostatic switch having a pair of terminals respectively supported by said bushings.

2. The construction according to claim 1 wherein each bushing has an axial opening and a bolt extends through each opening and is adapted to clamp the thermostatic switch terminals to respective bushings.

3. The construction according to claim 2 wherein one terminal of said thermostatic switch has a portion adapted to fit within the opening in the first-mentioned insulating bushing in only one relation.

4. The construction according to claim 1 wherein the first-named insulating bushing has a radial protrusion which abuts with a portion of said one arm to hold said bushing against substantial rotation.

5. The construction according to claim 1 wherein said one arm is formed of a pair of metal strips, each having a generally semicircular well, said strips being connected in juxtaposed relation with said wells complementary and forming a crotch at each side of their connection with adjoining portions of said strips, the first-mentioned insulating bushing having a central annular rib projecting radially therefrom, said rib being positioned within said complementary wells before said strips are connected, and said rib being locked within said complementary wells by connection of said strips, said rib having a radial protrusion which fits a selected crotch to hold said first-mentioned insulating bushing against material rotation within said complementary wells.

6. The construction according to claim 5 wherein said thermostatic switch terminals are adapted to be connected in electrical circuit with said heating coil and a source of electrical energy, one of said terminals having an extension fitting within an axial opening in said first-mentioned insulating bushing in only one predetermined manner.

7. The construction according to claim 6 wherein said axial opening has wide and narrow longitudinally-extending portions, and said terminal extension is a tab of a width to fit within said bushing opening only at said wide portion.

* * * * *